US010079433B2

(12) United States Patent
Ohgren et al.

(10) Patent No.: US 10,079,433 B2
(45) Date of Patent: Sep. 18, 2018

(54) MULTIFILAR HELIX ANTENNA

(71) Applicant: RUAG SPACE AB, Gothenburg (SE)

(72) Inventors: Mikael Ohgren, Ojersjo (SE); Joakim Johansson, Tollsjo (SE); Patrik Dimming, Torslanda (SE)

(73) Assignee: Ruag Space AB, Gothenburg (SE)

( * ) Notice: Subject to any disclaimer, the term of this patent is extended or adjusted under 35 U.S.C. 154(b) by 0 days.

(21) Appl. No.: 15/519,976

(22) PCT Filed: Oct. 20, 2014

(86) PCT No.: PCT/SE2014/051233
§ 371 (c)(1),
(2) Date: Apr. 18, 2017

(87) PCT Pub. No.: WO2016/064307
PCT Pub. Date: Apr. 28, 2016

(65) Prior Publication Data

US 2017/0317423 A1 Nov. 2, 2017

(51) Int. Cl.
*H01Q 11/08* (2006.01)
*H01Q 11/14* (2006.01)
(Continued)

(52) U.S. Cl.
CPC ..... *H01Q 11/08* (2013.01); *H01Q 1/36* (2013.01); *H01Q 11/14* (2013.01); *H01Q 21/24* (2013.01)

(58) Field of Classification Search
CPC ..... H01Q 1/36; H01Q 1/40; H01Q 1/362; H01Q 11/14; H01Q 11/08; H01Q 21/24
(Continued)

(56) References Cited

U.S. PATENT DOCUMENTS 3,702,481 A * 11/1972 Koller ..... H01Q 1/08 342/371
3,906,509 A * 9/1975 DuHamel ..... H01Q 1/362 343/895

(Continued)

FOREIGN PATENT DOCUMENTS

| | | |
|---|---|---|
| EP | 0666612 B1 | 8/2001 |
| WO | 9618220 A1 | 6/1996 |
| WO | 0145206 A1 | 6/2001 |

OTHER PUBLICATIONS

International Search Report and Written Opinion for PCT/SE2014/051233, dated Jun. 12, 2015.

(Continued)

*Primary Examiner* — Lam T Mai
(74) *Attorney, Agent, or Firm* — Brinks Gilson & Lione

(57) ABSTRACT

The invention relates to a multifilar helix antenna (1) comprising a wave feed and polarizing section (2) comprising a cover portion (3) comprising a through opening (4). The antenna (1) comprises a helix radiator (5) comprising three or more resonant helical elements (6) evenly distributed about an imaginary circle. Each helical element (6) extends in a longitudinal direction (Z) from the feed and polarizing section (2) through the opening (4) in the cover portion (3) and wound to form the helix radiator (5). Each helical element (6) comprises one or a plurality of wave perturbations (7) separated in the longitudinal direction (Z) and that each set of perturbations are positioned at the same level in the longitudinal direction (Z) to yield an equivalent array of stacked helical radiators, wherein the cover portion (3) comprises a rotationally symmetric corrugated assembly (8).

18 Claims, 3 Drawing Sheets

(51) Int. Cl.
*H01Q 1/36* (2006.01)
*H01Q 21/24* (2006.01)

(58) Field of Classification Search
USPC ..... 343/895, 853, 859
See application file for complete search history.

(56) References Cited

U.S. PATENT DOCUMENTS 5,450,093 A * 9/1995 Kim ..... H01Q 11/08 343/853
5,572,172 A * 11/1996 Standke ..... H01P 5/10 333/128
5,587,719 A * 12/1996 Steffy ..... B64G 1/22 343/853
5,721,557 A 2/1998 Wheeler et al.
5,793,338 A * 8/1998 Standke ..... H01Q 11/08 333/26
5,828,348 A * 10/1998 Tassoudji ..... H01Q 11/08 343/895
5,838,285 A * 11/1998 Tay ..... H01Q 1/38 343/895
6,011,524 A * 1/2000 Jervis ..... H01Q 1/42 343/859
6,018,326 A * 1/2000 Rudisill ..... H01Q 1/084 343/895
6,150,994 A * 11/2000 Winter ..... H01Q 1/242 343/860
6,163,307 A * 12/2000 Kim ..... H01Q 1/242 343/702
6,246,379 B1 6/2001 Josypenko
6,333,722 B1 12/2001 Kitano
2004/0257297 A1 12/2004 Petros
2009/0096704 A1 4/2009 Makarov et al.

OTHER PUBLICATIONS

International Preliminary Report on Patentability for PCT/SE2014/051233, dated Jun. 15, 2015.
Ying Z et al., "Reduced sidelobes and cross-polarization of axial mode helix using a soft corrugated ground plane", Jun. 28, 1993.
Extended European Search Report for European Application No. 14904244.2, dated May 18, 2018.

* cited by examiner

MULTIFILAR HELIX ANTENNA

RELATED APPLICATIONS

This application claims the benefit under 35 U.S.C. § 371 of the filing date of International Patent Application No. PCT/SE2014/051233, having an international filing date of Oct. 20, 2014, the content of which is incorporated herein by reference in its entirety.

TECHNICAL FIELD

The invention relates to a multifilar helix antenna comprising a wave feed and polarizing section comprising a cover portion comprising a through opening. The antenna comprises a helix radiator comprising three or more resonant helical elements evenly distributed about an imaginary circle. Each helical element extends in a longitudinal direction from the feed and polarizing section through the opening in the cover portion and wound to form the helix radiator.

BACKGROUND ART

The invention relates to multifilar helix antennas, for example described in WO 96/18220, specifically with isoflux radiation patterns. Satellites need antennas with various antenna pattern characteristics. The isoflux diagram is used in satellite antennas to illuminate the Earth in such a way that the power density is essentially constant regardless of where the ground station is located within the coverage area. The desired diagram is thus a conical rotationally symmetric diagram with the boresight in the nadir direction. The prefix iso-, from the Ancient Greek prefix ισοζ ("equal"), is here used to denote equal flux density. Assuming a spherical Earth with the radius Re and an orbit height of h, the following gain pattern gives the desired isoflux characteristic:

$$\frac{G(\theta)}{G(\theta_0)} = \left[\frac{\cos\theta - \sqrt{\cos^2\theta - \cos^2\theta_0}}{\cos\theta_0}\right]^2 \quad \theta \le \theta_0 \quad \sin\theta_0 = \frac{R_e}{R_e + h} \qquad \text{Eq. 1}$$

The formula does not correct for any atmospheric refraction, nor the minimum ground station elevation. In the WGS84 reference ellipsoid the Earth radius is 6378137 m.

FIG. 1 shows a schematic view over a satellite, Sat, and the earth approximated as a circle and a ground station, Gnd Stn.

The power pattern in the nadir direction is lower than at the edge of coverage (EOC), viz.

$$\frac{G(\theta)}{G(\theta_0)} = \left[\frac{1 - \sin\theta_0}{\cos\theta_0}\right]^2 = \frac{1}{1 + 2\frac{R_e}{h}} \qquad \text{Eq. 2}$$

A traditional all-metal quadrifilar helix antenna will suffer from a number of problems if the gain is increased by increasing the length of the helix radiator:

- It will be difficult to maintain the correct beam properties, e.g. an isoflux pattern with good cross-polarization discrimination.
- The conical beam peak tends to scan with frequency.
- The back radiation and the slope outside the edge of coverage will be difficult to control.

- The heat dissipated in the antenna will be difficult to conduct down to the base, thereby increasing the temperature at the top of the helix radiator and generating a thermal gradient along the helix.
- The structural properties will be degraded (lowered mechanical eigenfrequency).
- Various helix modes can interfere and yield resonances.

There is a long-felt need to solve these problems to make it possible to increase the gain in existing helix antennas.

The main objective is thus to achieve an antenna that has a desired isoflux radiation pattern within the coverage region, along with suppressed radiation in the other directions. Also, the cross-polarization discrimination within the coverage is an important requirement.

There are several ways to achieve this type of patterns, e.g. large corrugated hats and helix antennas. The quadrifilar helix antenna (QFHA) is very efficient in this respect, and can enable a very small dimensional footprint, where the length of the antenna essentially determines the possible peak gain. However, the QFHA has other drawbacks discussed below why an improved antenna is desired.

Here, the nadir direction at a given point is the local vertical direction pointing in the direction of the force of gravity at that location. The direction opposite of the nadir is the zenith direction.

DESCRIPTION OF THE INVENTION

The invention relates to a multifilar helix antenna comprising a wave feed and polarizing section comprising a cover portion comprising a through opening. The antenna comprises a helix radiator comprising three or more resonant helical elements evenly distributed about an imaginary circle. Each helical element extends in a longitudinal direction from the feed and polarizing section through the opening in the cover portion. Each helical element is wound in a spiral/helical pattern to form the helix radiator. Each helical element comprises one or a plurality of wave perturbations separated in the longitudinal direction and each set of perturbations are positioned at the same level or essentially at the same level in the longitudinal direction to yield an equivalent array of stacked helical radiators. The cover portion comprises a rotationally symmetric corrugated assembly.

Hence, the invention relates to an improved helix antenna utilizing a combination of a trifilar radiator, perturbations along the helix and corrugations in the cover portion. Using a trifilar radiator reduces to a minimum modes that can cause resonances, and decreases the azimuthal ('omni') radiation pattern variation, which is the case with a quadrifilar helix antenna. The perturbations create an equivalent array of stacked helices to enable beam shaping for increased edge of coverage gain over a significant bandwidth, as well as a tailored frequency scan of the conical beam; this allows for a shorter helix radiator. The corrugations in the cover portion decrease the back-radiation coupling into the feed section.

A helix radiator comprising three or a multiple of three resonant helical elements evenly distributed about an imaginary circle gives the most advantageous antenna due to the above stated combination of advantages. However, a quadrifilar radiator, i.e. a helix radiator comprising four, quadrifilar, or more resonant helical elements evenly distributed about an imaginary circle has advantages. The perturbations still create an equivalent array of stacked helices to enable beam shaping for increased edge of coverage gain over a significant bandwidth, as well as a tailored frequency scan of the conical beam; this allows for a shorter helix radiator. The corrugations in the cover portion decrease the back-radiation coupling into the feed section.

The helical elements are wound equidistant with relation to each other and in the same cylindrical or conical plane. Here, the cylindrical or conical plane refers to the curved envelope surface of the three dimensional body.

The wave perturbations are positioned at the same level or essentially at the same level in the longitudinal direction to yield an equivalent array of stacked helical radiators. The perturbations can be positioned at somewhat different levels dependent the design of the antenna and the desired lobe forming. It is advantageous to have the wave perturbations positioned at the same level for reasons of symmetry.

As mentioned above, compared to a quadrifilar helix antenna, the use of a trifilar radiator removes the mode that can cause resonances, as well as decreasing the azimuthal ('omni') radiation pattern variation. The typical quadrifilar helix antenna, QFHA, comprises four helical elements and a feed network that will excite these helices in a desired phase sequence. The phase sequence should be 0, ±90, ±180 and ±270 degrees for the four helix excitations. With the right combination of sequence rotation direction and helix handedness, the QFHA will radiate a desired shaped antenna diagram with a circular polarization, either right hand circular polarization, RHCP, or left hand circular polarization, LHCP.

A uniform multifilar helix transmission line with N wires will support N−1 propagating modes. In the example of N=4, these will be the desired 0, ±90, ±180 and ±270 degrees phase sequence modes, as well as a third differential mode with 0, 180, 0 and 180 degrees phase sequencing. The two dominant modes will have different characteristics. One of these modes will be a slow wave transmission line mode with a phase velocity less than the speed of light. The other mode will be a fast wave mode with a phase velocity larger than the speed of light. This will result in a leaky wave, i.e. the wave is constantly radiating along the length and thus attenuated. Under certain conditions the phase velocity is negative, and the wave will radiated in a backward direction.

In a traditional QFHA the 'third' differential mode has no utility but could be excited by asymmetries and then cause resonances when an unfortunate phasing is achieved. This could severely limit the frequency range of this type of antenna.

Typically, a QFHA is arranged in such a way that the feed is located at the bottom of the antenna, i.e. the cover portion of the wave feed and polarizing section. The feed sequence will then excite a slow wave transmission line mode that will travel upwards along the helix structure. At the top of the structure, the wave will be reflected. The reflection will result in a reversion of the phasing sequence, and the mode of the reflected wave will travel down the helix structure towards the feed. The leaky reflected wave will then radiate a desired conical lobe pattern in the upper hemisphere, where the leakage propagation constant determines the characteristics.

The current distribution along the antenna is the combination of the above-mentioned slow and fast waves.

There will essentially be three degrees of freedom to shape the pattern in a uniform helix antenna: the helix radiator diameter, the helix radiator length, and the helix radiator pitch angle. These parameters are not enough to get the desired isoflux characteristics over a substantial frequency range. The helix diameter and pitch are mutually constrained by the need to support the appropriate up- and downward waves to achieve an isoflux conical lobe maximum, and simultaneously provide minimum cross-polarization over a large angular range. This essentially leaves the helix length as the only design parameter to increase the edge-of-coverage gain. When increasing the length, the pattern will not be compliant to a desired isoflux type pattern mask.

However, it has now been discovered that a uniform trifilar helix transmission line according to the invention will support two propagating modes, i.e. 0, ±120, and ±240 degrees phase sequence modes. The differential mode that is supported in a quadrifilar structure will thus not be supported in a trifilar structure, and hence the problems arising from this mode will disappear in the trifilar case.

The useful modes, i.e. the slow-wave transmission line mode and the fast wave leaky radiating mode, will combine in the antenna to give a certain current distribution. The typical way to achieve this is to excite an upward traveling transmission line mode at the base of the antenna, and then reflect the wave at the top of the antenna, i.e. at the far end of the helix radiator from the cover portion in the longitudinal direction, through either leaving the conductors, i.e. the helical elements, open or shorting them together. The helix transmission line has the property that a discontinuity will yield a reflection that is the opposite mode of the impending one. Hence the upward traveling transmission line mode will be converted to a downward traveling radiating mode. In the bottom-fed helix, one would desire total reflection of the wave at the top, and this is almost ideally achieved by leaving the conductors, i.e. the helical elements, open or shorted together. Hence, the helical elements are either connected or disconnected on the far end of the helix radiator in the longitudinal direction with relation to the cover portion.

However, a reflected wave could also be the result of any discontinuity along the helix structure. Here, the discontinuity refers to the perturbation. The perturbations can be achieved by a number of different solutions taken alone or in combination; for example a discontinuity in wave impedance by, for example, changing the cross-section, inductive and/or capacitive series and/or shunt elements, and the inclusion or removal of dielectrics. Hence, in one example the perturbation is an indentation in the helical element. In one example, the perturbation is a protrusion on the helical element. In one example the perturbation is a different material in the helical element compared to the main material in the helical element. According to one example, the different material may be a mix between the main material in the helical element and one or more different materials, and according to another example the different material replaces an entire portion of the helical element. The latter example may be achieved by putting together different portions of materials in a self-supporting structure or may be achieved by having different materials positioned onto a dielectric material from which the helical pattern is etched. Hence, according to one example each helical element is an all-metal self-supporting structure having the same material composition over its entire length or having different material composition on different places in order to create perturbations. Both examples allow for further perturbations according to the above. Furthermore, according to one example each helical element is a metallic pattern on a common dielectric sheet having the same material composition over its entire length or having different material composition on different places in order to create perturbations. Both examples allow for further perturbations according to the above.

The wave feed and polarizing section comprises as many taps as there are helical elements with corresponding angles of electrical phasing with equal amplitude over a desired significant bandwidth, typically 5%. According to the invention, the wave feed and polarizing section is arranged to excite the helical elements in a desired phase sequence. The phase sequence should be ±120, and ±240 degrees for the three helix excitations. With the right combination of phase sequence rotation direction and helix handedness, the helical radiator will radiate a desired shaped antenna diagram with a circular polarization, either right hand circular polarization, RHCP, or left hand circular polarization, LHCP. Hence, the wave feed and polarizing section produces a circular polarization that allows for easy division into the helical elements. The division may be done by a mechanical arrangement in the wave feed and polarizing section.

The corrugated assembly is located on or in connection to the cover portion separating the wave feed and polarizing section and the helix radiator.

According to one example, the corrugated assembly comprises a recessed portion in the cover portion or in connection to the cover portion for decreasing back-radiation coupling into the feed and polarizing section.

According to one example, the recessed portion is arranged in a circularly symmetric manner about the helix radiator. According to one example, the corrugated assembly comprise one or many ring shaped units mounted on the cover portion or being a part of the cover portion. The ring shaped units then has an elevation above the general surface of the cover and thus builds a recessed portion between the elevation and the general surface. The ring shaped unit(s) may also be U-shaped with two side walls and a bottom wall that creates an open space between the three walls being the recessed portion. According to one example, the corrugated assembly comprises one or many ring shaped indentations arranged in the cover portion, where the general surface of the cover portion is an elevated portion in relation to the indentation, wherein the indentation is a recessed portion.

According to one example, the recessed portion comprises at least two parts arranged in a radial direction about the helix radiator. The radial direction is a direction perpendicular to the longitudinal direction. Hence, in this example the recessed parts are positioned in a plane being perpendicular to the longitudinal direction. In another example, the recessed portions are arranged in a direction having a component in the radial direction and a component in the longitudinal direction. Hence, in this example the recessed parts are positioned in a cone shaped plane with a centre common to the helix radiator. Also here, the recessed portion may be the result of an elevation on the general surface or an indentation in the general surface as described above in the ring shaped example.

According to one example, the cover portion is partly or fully a common ground plane to which the helix radiator is associated.

According to one example, the antenna comprises a dielectric radome covering the helix radiator. The radome protects the helix radiator but may additionally mechanically support the helix structure at one or several positions along the helix radiator.

The above mentioned arrangement has been demonstrated to be especially good for a trifilar helix radiator, i.e. three helical elements, and a hexifilar helix radiator, i.e. six helical elements.

BRIEF DESCRIPTION OF DRAWINGS

The invention will below be described in connection to a number of drawings, in which:

FIG. 2 schematically shows a perspective view of one example of a trifilar helix antenna according to the invention, and in which;

DETAILED DESCRIPTION OF DRAWINGS

In the figures, like items are denoted with the same numbers.

Figure 1:
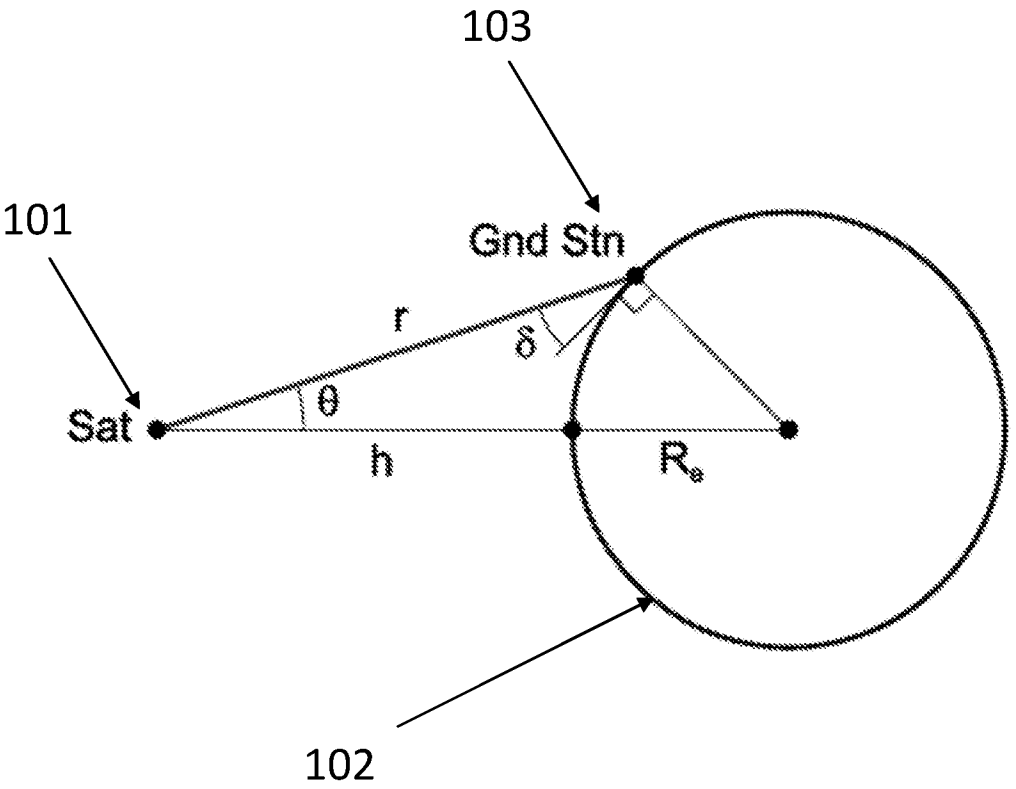
FIG. 1 shows a schematic view over a satellite, Sat, 101 and the earth 102 approximated as a circle and a ground station, Gnd Stn, 103, for the calculations in background art.

FIG. 1 shows a schematic view over a satellite, Sat, 101 and the earth 102 approximated as a circle and a ground station, Gnd Stn, 103, for the calculations in background art.

Figure 2:
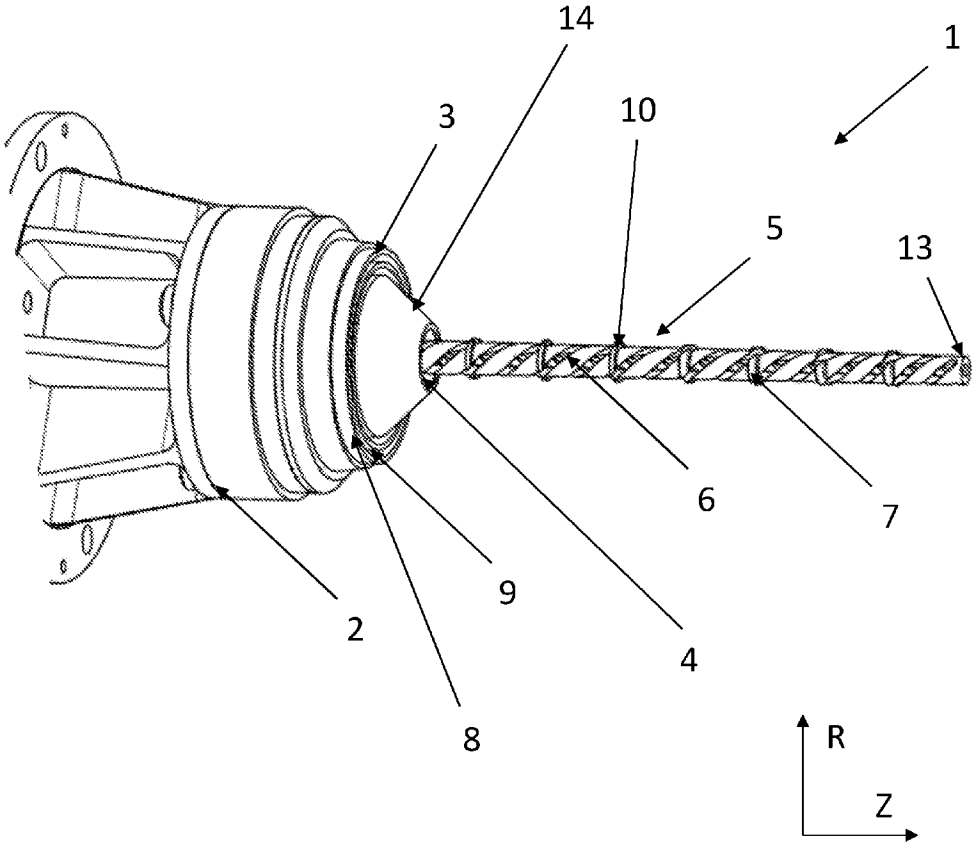

FIG. 2 schematically shows a perspective view of one example of a trifilar helix antenna 1 according to the invention.

In FIG. 2 the multifilar helix antenna 1 comprises a wave feed and polarizing section 2 comprising a cover portion 3 comprising a through opening 4. The antenna 1 comprises a helix radiator 5 comprising three resonant helical elements 6 evenly distributed about an imaginary circle. Each helical element 6 extends in a longitudinal direction Z from the feed and polarizing section 2 through the opening 4 in the cover portion 3 and wound to form the helix radiator 5. Each helical element 6 comprises one or a plurality of wave perturbations 7 separated in the longitudinal direction Z and that each triple of perturbations are positioned at the same level in the longitudinal direction Z to yield an equivalent array of stacked helical radiators, wherein the cover portion 3 comprises a rotationally symmetric corrugated assembly 8.

The wave feed and polarizing section 2 comprises as many taps as there are helical elements 6 with corresponding angles of electrical phasing with equal amplitude over a desired significant bandwidth.

In FIG. 2 each helical element 6 is an all-metal self-supporting structure. However, according to another example, not shown, each helical element 6 is a metallic pattern on a common dielectric sheet.

In FIG. 2 the perturbation 7 comprises a wave impedance discontinuity in the form of a protrusion 10 on the helical element 6. According to another example, not shown, the perturbation 7 is an indentation in the helical element 6. According to one example, the perturbation 7 is a different material in the helical element 6 compared to the main material in the helical element 6.

In FIG. 2 the helical elements 6 are electrically connected at the far end 13 of the helix radiator 5 in the longitudinal direction with relation to the cover portion. However, another example, not shown, the helical elements 6 are disconnected on the far end 13 of the helix radiator 5 in the longitudinal direction with relation to the cover portion 3.

In FIG. 2 the helical elements 6 are wound equidistant with relation to each other and in the same cylindrical plane. However in another example the helical elements 6 are wound equidistant with relation to each other and in the same conical plane.

In FIG. 2 the corrugated assembly 8 comprises two recessed portions 9 in the cover portion 3 for decreasing back-radiation coupling into the feed and polarizing section 2. The recessed portions 9 are arranged in a circularly symmetric manner about the helix radiator 5.

According to one example, not shown, the recessed portion 9 comprises at least two parts arranged in a radial direction R about the helix radiator 5. The radial direction R is a direction perpendicular to the longitudinal direction Z. In FIG. 2, the recessed portions are arranged in a direction having a component in the radial direction R and a component in the longitudinal direction Z, i.e. the plane in which the recessed portions are positioned are at an angle to the longitudinal direction and may be in the form of a cone shape or any other suitable shape.

In FIG. 2 the cover portion 3 comprises a reflection portion 14 in the form of a cone. The reflection portion 14 is designed to reflect unwanted and leaked waves in a direction away from the antennas intended direction of use. The reflection portion 14 is designed dependent on desired performance and may thus have any suitable shape and for, for example, conical, cylindrical and curved.

Figure 3:
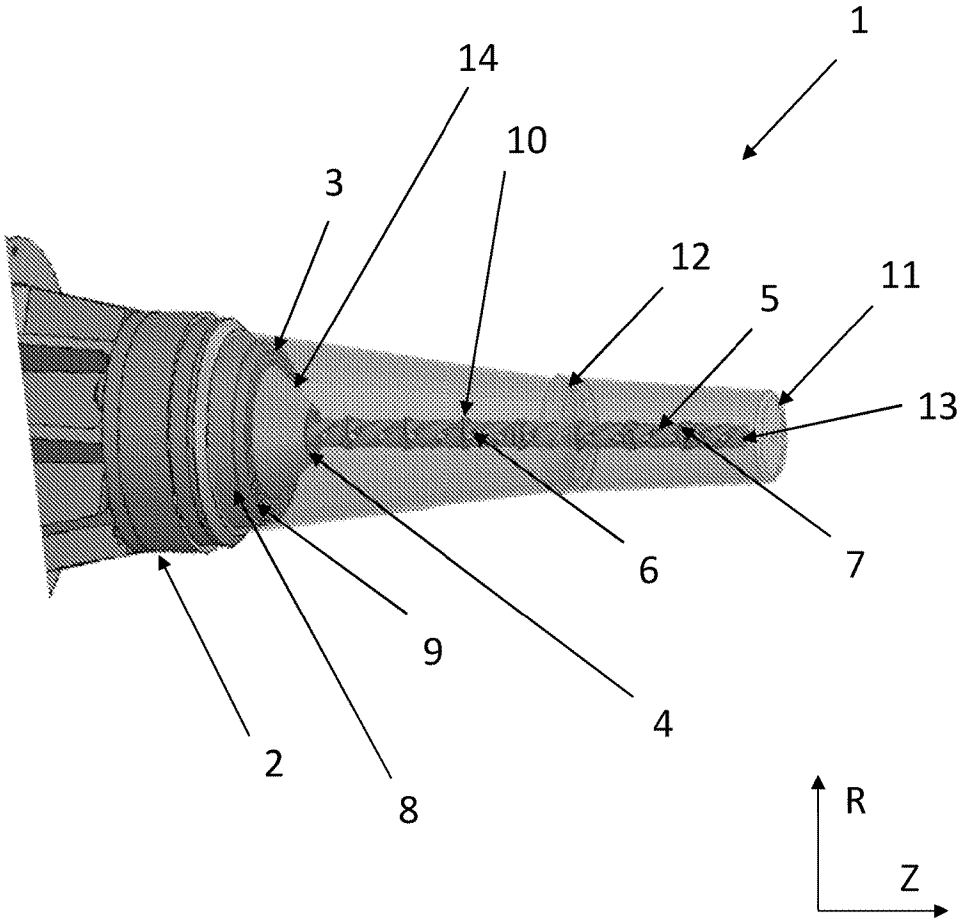
FIG. 3 shows a trifilar helix antenna according to FIG. 1 with a radome.

FIG. 3 shows a trifilar helix antenna according to FIG. 2 with a radome 11. The radome 11 is dielectric and covers the helix radiator 5. The radome 11 may comprise support units 12 for supporting the helix radiator 5. The support units 12 is advantageously positioned in connection to the perturbations 7 since other parts of the helix radiator is then not affected impedance wise of any connection to the support units 12.

The invention claimed is:

1. A multifilar helix antenna comprising a wave feed and polarizing section comprising a cover portion comprising a through opening, the antenna comprising a helix radiator comprising three or more resonant helical elements evenly distributed about an imaginary circle, each helical element extending in a longitudinal direction (Z) from the feed and polarizing section through the opening in the cover portion and wound to form the helix radiator, characterized in that each helical element comprises one or a plurality of wave perturbations separated in the longitudinal direction (Z) and that each set of perturbations are positioned at the same level in the longitudinal direction (Z) to yield an equivalent array of stacked helical radiators, wherein the cover portion comprises a rotationally symmetric corrugated assembly.

2. The antenna according to claim 1, wherein the wave feed and polarizing section comprises as many taps as there are helical elements with corresponding angles of electrical phasing with equal amplitude over a desired significant bandwidth.

3. The antenna according to claim 1, wherein the helix radiator is trifilar.

4. The antenna according to claim 1, wherein the helix radiator is hexifilar.

5. The antenna according to claim 1, wherein the helix radiator is quadrifilar.

6. The antenna according to claim 1, wherein each helical element is an all-metal self-supporting structure.

7. The antenna according to claim 1, wherein each helical element is a metallic pattern on a common dielectric sheet.

8. The antenna according to claim 1, wherein the perturbation comprises a wave impedance discontinuity.

9. The antenna according to claim 1, wherein the perturbation is an indentation in the helical element.

10. The antenna according to claim 1, wherein the perturbation is a protrusion on the helical element.

11. The antenna according to claim 1, wherein the perturbation is a different material in the helical element compared to the main material in the helical element.

12. The antenna according to claim 1, wherein the helical elements are electrically connected at the far end of the helix radiator in the longitudinal direction with relation to the cover portion.

13. The antenna according to claim 1, wherein the helical elements are disconnected on the far end of the helix radiator in the longitudinal direction with relation to the cover portion.

14. The antenna according to claim 1, wherein the helical elements are wound equidistant with relation to each other and in the same cylindrical or conical plane.

15. The antenna according to claim 1, wherein the corrugated assembly comprises a recessed portion in the cover portion or in connection to the cover portion for decreasing back-radiation coupling into the feed and polarizing section.

16. The antenna according to claim 15, wherein the recessed portion is arranged in a circularly symmetric manner about the helix radiator.

17. The antenna according to claim 15, wherein the recessed portion comprises at least two parts arranged in a radial direction (R) about the helix radiator, wherein the radial direction (R) is a direction perpendicular to the longitudinal direction (Z), or wherein the recessed portions are arranged in a direction having a component in the radial direction (R) and a component in the longitudinal direction (Z).

18. The antenna according to claim 1, wherein the antenna comprises a dielectric radome covering the helix radiator.

* * * * *